US006629395B1

(12) United States Patent
Karanikas

(10) Patent No.: US 6,629,395 B1
(45) Date of Patent: Oct. 7, 2003

(54) WALL UNIT FORMING METHOD AND APPARATUS

(76) Inventor: Terry Karanikas, 19 Queens Way, Queensbury, NY (US) 12804

( * ) Notice: Subject to any disclaimer, the term of this patent is extended or adjusted under 35 U.S.C. 154(b) by 0 days.

(21) Appl. No.: 09/488,895

(22) Filed: Jan. 21, 2000

(51) Int. Cl.[7] ..... E04G 11/06

(52) U.S. Cl. ..... 52/745.19; 52/749.13; 52/315; 52/612; 52/249; 52/15; 52/34; 52/35; 52/194

(58) Field of Search ..... 52/745.1, 745.11, 52/745.12, 745.14, 745.19, 749.13, 315, 612; 249/15, 16, 34, 35, 39, 170, 194, 195; 425/DIG. 241; 264/247

(56) References Cited

U.S. PATENT DOCUMENTS

| | | | | | |
|---|---|---|---|---|---|
| 969,248 | A | * | 9/1910 | Davis et al. | 249/15 |
| 1,028,013 | A | * | 5/1912 | Fuller | 249/16 X |
| 1,444,588 | A | * | 2/1923 | Copeland | 249/15 |
| 1,507,085 | A | * | 9/1924 | Newman | 52/315 X |
| 1,627,171 | A | * | 5/1927 | Gottschalk | 249/15 X |
| 1,678,613 | A | * | 7/1928 | Weiss | 264/247 |
| 1,691,721 | A | * | 11/1928 | Johnson | 52/315 X |
| 1,809,504 | A | * | 6/1931 | Carvel | 52/745.11 |
| 1,838,203 | A | * | 12/1931 | Wales | 52/315 |
| 1,856,906 | A | | 5/1932 | Carvel | |
| 1,902,271 | A | * | 3/1933 | Warner | 52/315 |
| 1,916,308 | A | * | 7/1933 | Grieco | 52/315 |
| 1,950,397 | A | * | 3/1934 | Cahill | 52/220.2 X |
| 2,047,648 | A | * | 7/1936 | Pollard | 52/315 |
| 2,149,784 | A | * | 3/1939 | McClatchy et al. | 52/315 |
| 2,178,535 | A | * | 10/1939 | Willson | 249/15 X |
| 2,465,871 | A | * | 3/1949 | Hardie et al. | 249/15 X |
| 2,467,590 | A | | 4/1949 | Johnson | |
| 2,890,492 | A | | 6/1959 | Smith | |
| 3,116,570 | A | * | 1/1964 | Torricelli | 52/284 X |
| 3,231,646 | A | * | 1/1966 | Conder et al. | 52/749.13 X |
| 3,390,496 | A | * | 7/1968 | Weiner et al. | 52/315 X |
| 3,391,507 | A | * | 7/1968 | Downing | 52/606 X |
| 3,737,511 | A | | 6/1973 | Dillon | |
| 3,839,519 | A | | 10/1974 | Weiner | |
| 4,049,874 | A | | 9/1977 | Aoyama et al. | |
| 4,084,362 | A | * | 4/1978 | Piazza | 52/309.2 |
| 4,141,755 | A | * | 2/1979 | Weiss et al. | 52/517 X |
| 4,223,502 | A | | 9/1980 | Robinson | |
| 4,668,462 | A | | 5/1987 | Smith | |
| 4,743,414 | A | | 5/1988 | Sudrabin | |
| D306,489 | S | | 3/1990 | Karanikas | |
| 4,915,888 | A | | 4/1990 | Sato | |
| 5,009,387 | A | * | 4/1991 | Scott et al. | 249/15 X |
| 5,040,344 | A | | 8/1991 | Durand | |
| 5,129,150 | A | | 7/1992 | Sorensen | |
| 5,268,137 | A | * | 12/1993 | Scott et al. | 249/189 X |
| 5,481,836 | A | | 1/1996 | Miller et al. | |
| 5,511,761 | A | * | 4/1996 | Schultz | 249/34 |
| 5,624,615 | A | * | 4/1997 | Sandorff | 264/247 X |
| D379,670 | S | * | 6/1997 | Karanikas | D25/113 |
| 5,667,190 | A | * | 9/1997 | Scott et al. | 249/16 |
| 5,761,876 | A | | 6/1998 | Keady | |
| 6,032,424 | A | * | 3/2000 | Dial, Jr. | 264/247 X |

FOREIGN PATENT DOCUMENTS

| | | | | |
|---|---|---|---|---|
| CA | 584829 | * | 10/1959 | 52/315 |

* cited by examiner

*Primary Examiner*—Laura A. Callo
(74) *Attorney, Agent, or Firm*—Schmeiser, Olsen & Watts

(57) ABSTRACT

A method of forming a wall unit having a veneer face is disclosed. Initially, a pair of side wall panels and a pair of end panels are mounted substantially upright. Stones or other suitable material are set sequentially in a horizontally disposed course using at least one of the panels. Additional courses of stones or other material may then be stacked upon the initial layer until the desired height is attained. The interior volume of the apparatus is left substantially empty, and is then filled with a binding material. The binding material binds the courses' components together and integrates the individual courses into a single cohesive unit. The wall and end panels are removed and the unit is removed for subsequent installation.

19 Claims, 12 Drawing Sheets

WALL UNIT FORMING METHOD AND APPARATUS

BACKGROUND OF THE INVENTION

1. Technical Field

This invention relates generally to a method and apparatus for molding wall units, and in particular to constructing a wall unit having layered discrete veneer components, such as stones, on the outer surface.

2. Background Art

Various methods of forming a stone veneer on a single side of a wall unit have heretofore been performed. In one of the related art techniques, a plurality of stones are arranged face-down, forming a single horizontal layer, upon a base surface as discussed in U.S. Pat. No. 1,856,906.

The inherent disadvantage of this method is that, since it entails laying the veneer stones horizontally across the bottom of the form, it is limited to producing a stone veneer on only a single surface of the wall unit. Therefore, if a construction design calls for a wall unit having a stone veneer on more than one side, two wall units would have to be constructed separately and positioned back-to-back to produce the desired fixture. Similarly, if a design specified an end unit with a veneer on two or more sides, this would require two or more separate pours, with the attendant increase in manufacturing, shipping, and construction costs.

A second related art method is to pre-cast the core with a plurality of discrete attachment anchors (e.g. slots, ties, etc.) and then create the veneer on the previously finished core using a story pole, sandwiching, or other known technique. See, for example, U.S. Pat. No. 5,761,876 to Keady. This process requires at least two separate casting steps or "pours."

Thus, there exists a need for a method which can be used to produce a stone veneer on multiple sides of a wall unit in an efficient and cost effective manner, for instance, in a single pour of concrete. There also exists a related need for a method which can produce stone veneers on multiple curved, sloped, or angled wall unit surfaces.

SUMMARY OF THE INVENTION

The present invention provides a method for forming a wall unit using a molding technique, comprising: operationally attaching a plurality of panels in an upright manner; arranging two or more layers of discrete veneer components adjacent one of said plurality of panels; filling said volume with a binding material; and subsequent to curing of the binding material, removing said panels.

A wall unit form comprising a first surface; a second surface operatively attached to said first surface; end surfaces operatively attached to said first and second surfaces thereby forming an upright form and opposing sides; and optionally, a pocket structure operatively attached to at least one of said surfaces.

It is to be understood that both the foregoing general description and the following detailed description are exemplary, but are not restrictive, of the invention.

BRIEF DESCRIPTION OF THE DRAWINGS

The invention is best understood from the following detailed description when read in conjunction with the accompanying drawings. It is emphasized that, according to common practice and for the sake of clarity, the various features of the drawings are not drawn to scale. On the contrary, the dimensions of the various features may have been arbitrarily expanded or reduced. Included in the drawings are the following figures.

DETAILED DESCRIPTION OF THE PREFERRED EMBODIMENT

Figure 1:
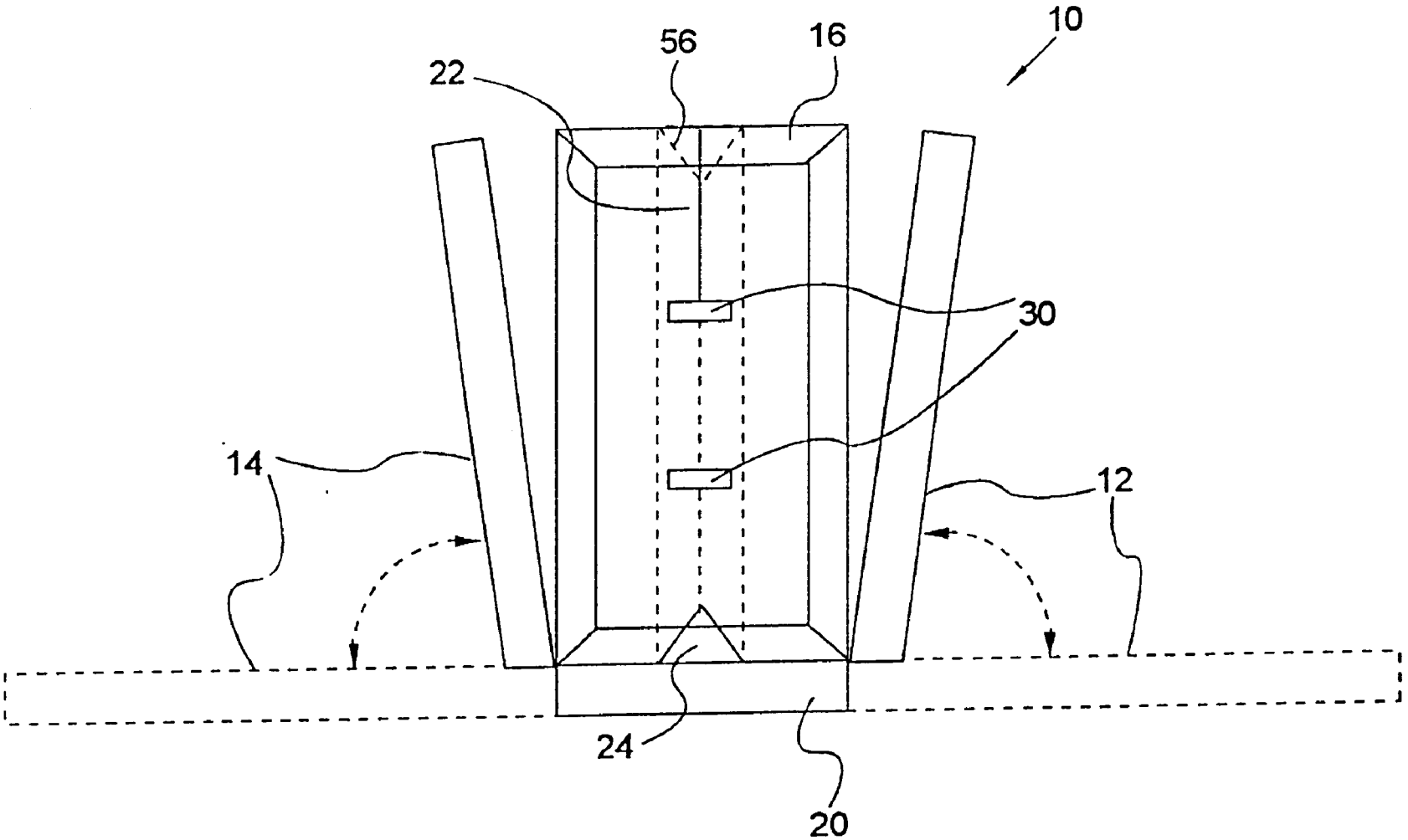
FIG. 1 is an end view of a wall unit form showing mounting of a pair of hinged or removable side panels and an end panel according to a preferred embodiment of the present invention.

The present invention generally provides a method for forming wall units, and in particular to a method for constructing a wall unit having layered discrete veneer components on the outer surface of at least one side.

The present invention further discloses the wall unit form which is utilized in the novel production method disclosed herein.

The term "stone" veneer is used throughout the description of the invention solely for ease of communication. There is no intent to limit the veneer material to stone. Rather, any discrete building component may be employed in the method described herein.

While this invention is susceptible to embodiment in many different forms, there is shown in the drawings, and will be described in detail, a preferred embodiment of the invention. It should be understood, however, that the present disclosure is to be considered as an exemplification of the principles of this invention and is not intended to limit the invention to the embodiment illustrated.

1. The Wall Unit Form

Figure 10:
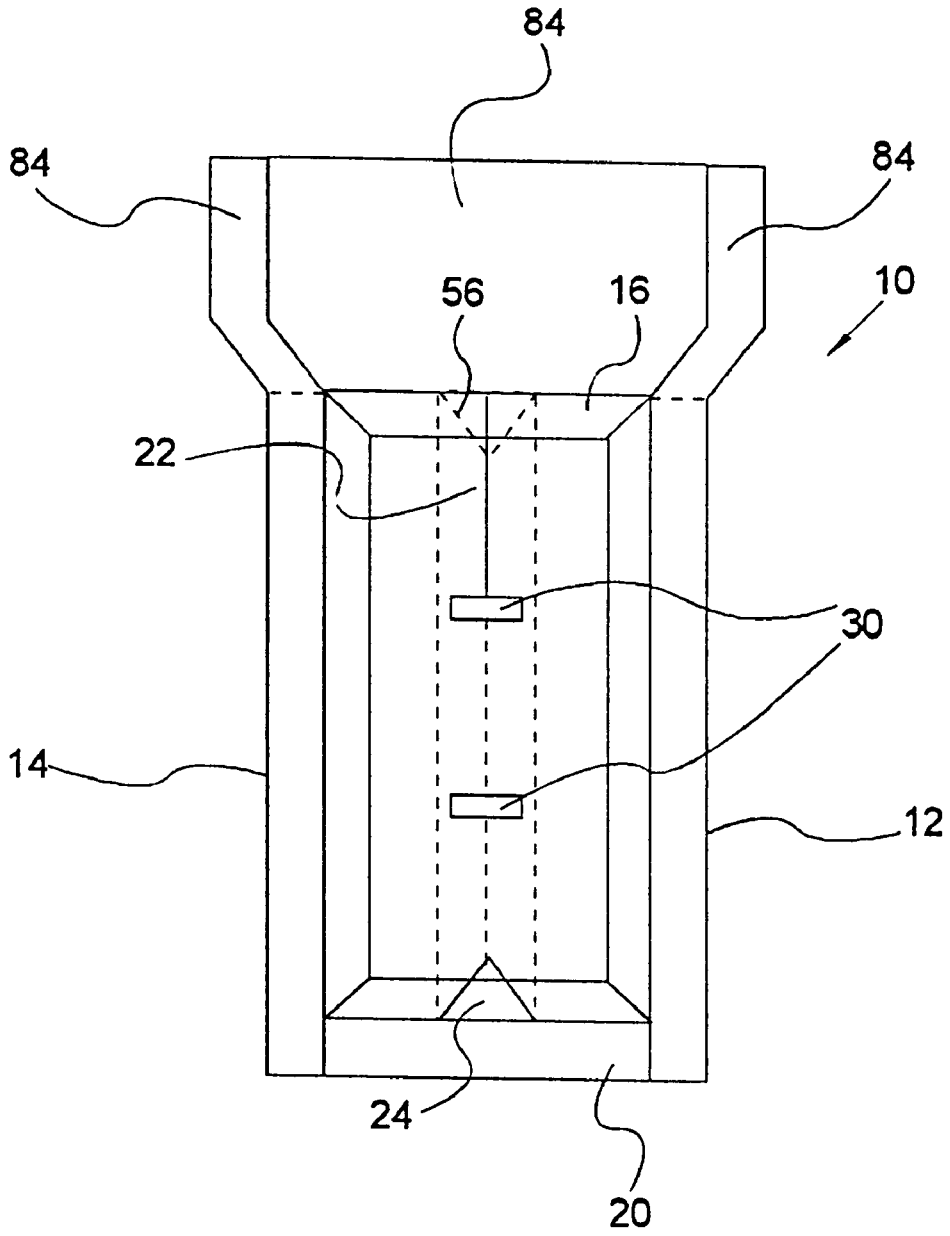
FIG. 10 depicts a perspective view of a wall unit form with extensions in place to form a base or footing according to one possible embodiment of the present invention.

Referring to FIG. 1, this figure shows an end view of a wall unit form 10 with first and second side panels 12, 14 and a first end panel 16. All of these panels, and second end panel 18 (FIG. 2), are mounted to each other upon the ground or upon a base panel 20, according to the present invention. The side panels 12, 14, as well as the first and second end panels 16, 18 can be hinged (as shown) or removably attached. An advantage of the movable panels 12, 14, 16, 18 is that they facilitate entry into the wall unit form 10 during various production operations as will be discussed in the Method section below. The wall unit form 10 may also include a cavity to accommodate material that will form a base or footing if the footing is to be molded as an integral piece of the wall unit 50. The base or footing cavity can be formed by extensions 84 that are attached, as necessary, to movable panels 12, 14, 16, 18 (FIG. 10). The extensions 84 may be of any required contour, and these are capable of producing a base having either squared or radiused corners and ends.

The wall unit form 10 is also adaptable to receive a form liner. The form liner is operationally attached to the interior of panels 12, 14, 16, 18 and facilitates the desired alignment of irregularly-shaped veneer components, in a random horizontal and vertical orientation, against the form liner. The form-liner is a smooth sheet of material such as, inter alia, wood, metal, plastic, or the like, which covers and protects the interior surface of panels 12, 14, 16, or 18, and which can be used to reduce the overall size of a finished wall unit. Thus, a single wall unit form 10, can be combined with a variety of different size form liners, to produce different size wall units. A form liner, as herein described, is thus distinguished from the "guide form" known in the related art (See, for example, U.S. Pat. No. 1,809,504 to Carvel, FIG. 18, element 24; and FIG. 26, element 32). The guide forms of the related art are affixed to the insides of the form panels to provide regular intervals between discrete components.

The base panel 20 is further adapted to receive a pocket forming structure such as a footing loop pocket structure 24. Use of the footing loop pocket structure 24 enables formation of a shear key or footing loop pocket 48 (FIGS. 3A, 3B) in the bottom surface of the wall unit 50.

The connecting loop pocket structure 22 (FIG. 2), the footing loop pocket structure 24 (FIG. 1), and the lifting loop pocket structure 56 (FIG. 1) are structures that are temporarily and removably placed upon the panels 12, 14, 16, 18 forming the wall unit form 10 to create longitudinal voids in the finished wall unit 50. These voids are useful for accommodating means for interlocking adjacent wall units 50 as will be discussed herein below. The loop pocket structures (connecting, footing, and lifting, 22, 24, 56, respectively) may be formed on any surface of the wall unit, but are typically formed on the ends, top, or bottom of the wall unit 50. The loop pocket structures 22, 24, 56 are typically vee-shaped, but they may have any another cross-sectional shape which may be more suited to a particular application. Finally, the loop pocket structures 22, 24 may be fabricated of metal, wood, plastic, or any other material having the structural properties required by this process.

Figure 2:
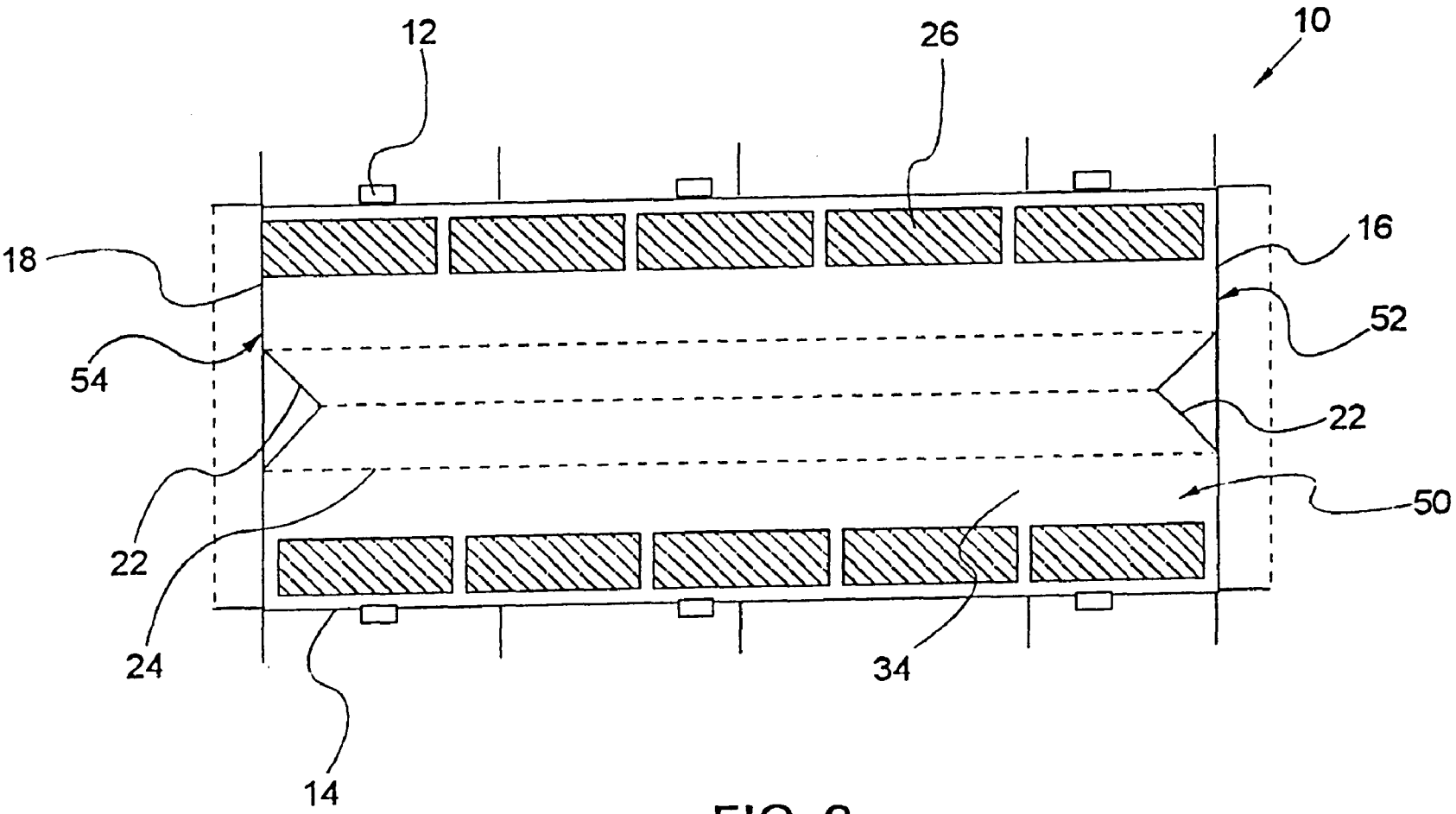
FIG. 2 is a plan view of the wall unit form of FIG. 1 according to a preferred embodiment of the present invention.

As shown in FIG. 2, the wall unit form 10 can receive a connecting loop pocket structure 22 at either or both ends. The connecting loop pocket structure 22 is attached to either or both end panels 16, 18. Use of the connecting loop pocket structure 22 allows a connecting loop pocket 46 (FIG. 3A) to be formed on the ends 52, 54 of the wall unit 50.

Figure 3A:
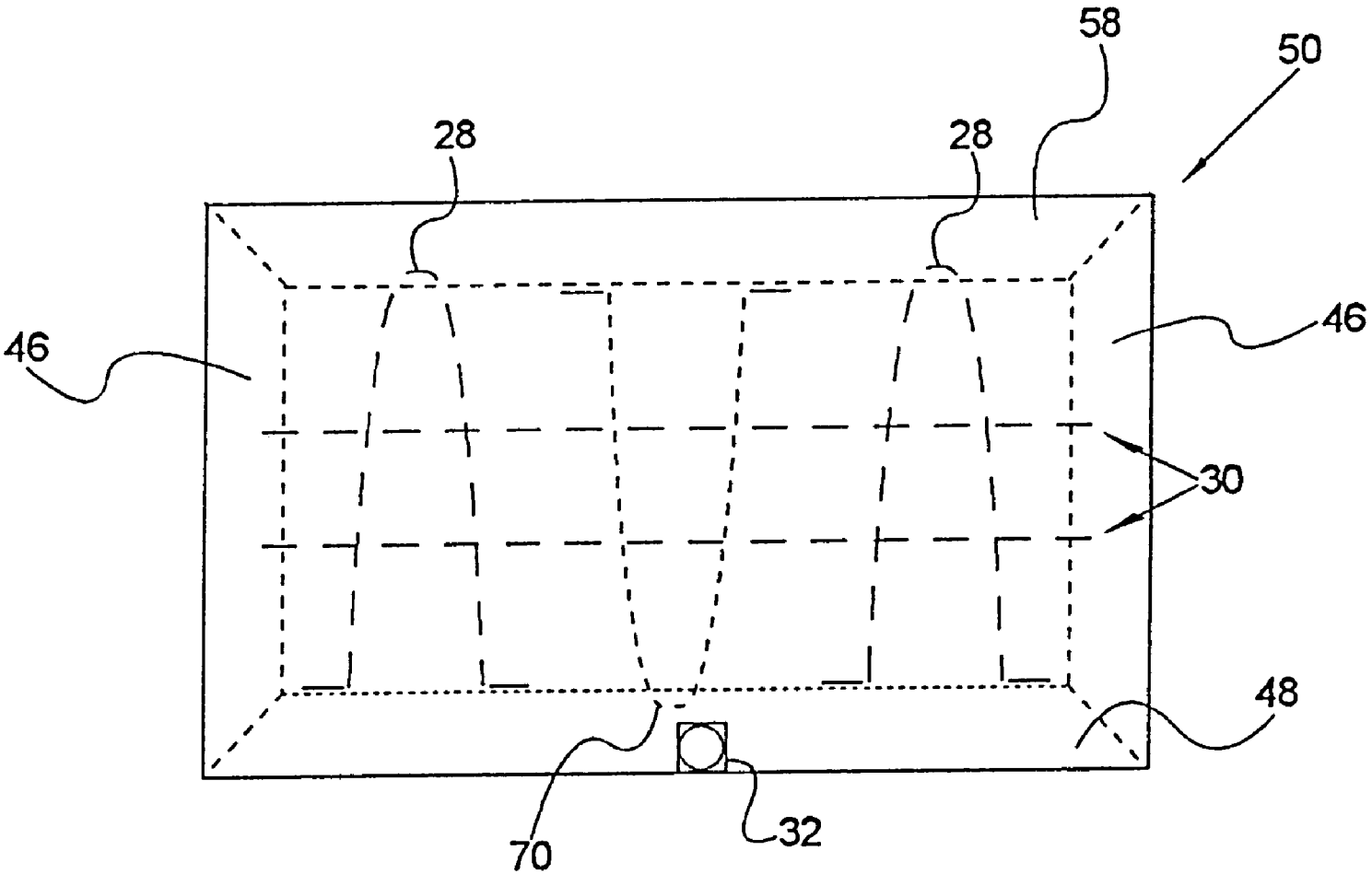
FIGS. 3A, 3B, and 3C depict front, side and top views, respectively, of a wall unit produced according to a preferred embodiment of the present invention.

Referring now to FIG. 3, there are shown several views of a wall unit 50. FIG. 3A presents a front view of a wall unit 50, showing a connecting loop pocket 46 at each end of the wall unit 50. Connecting loop rods 30 extend into the connecting loop pockets 46 from the interior of the wall unit 50. Similarly, lifting loop rods 28 extend into the lifting loop pocket 58, and provide a means for lifting the wall unit 50 when so required. The connecting loop rods 30 and the lifting loop rods 28 are typically formed from reinforcing rods, commonly known as rebar, of sufficient size and quantity as dictated by the application.

Figure 4:
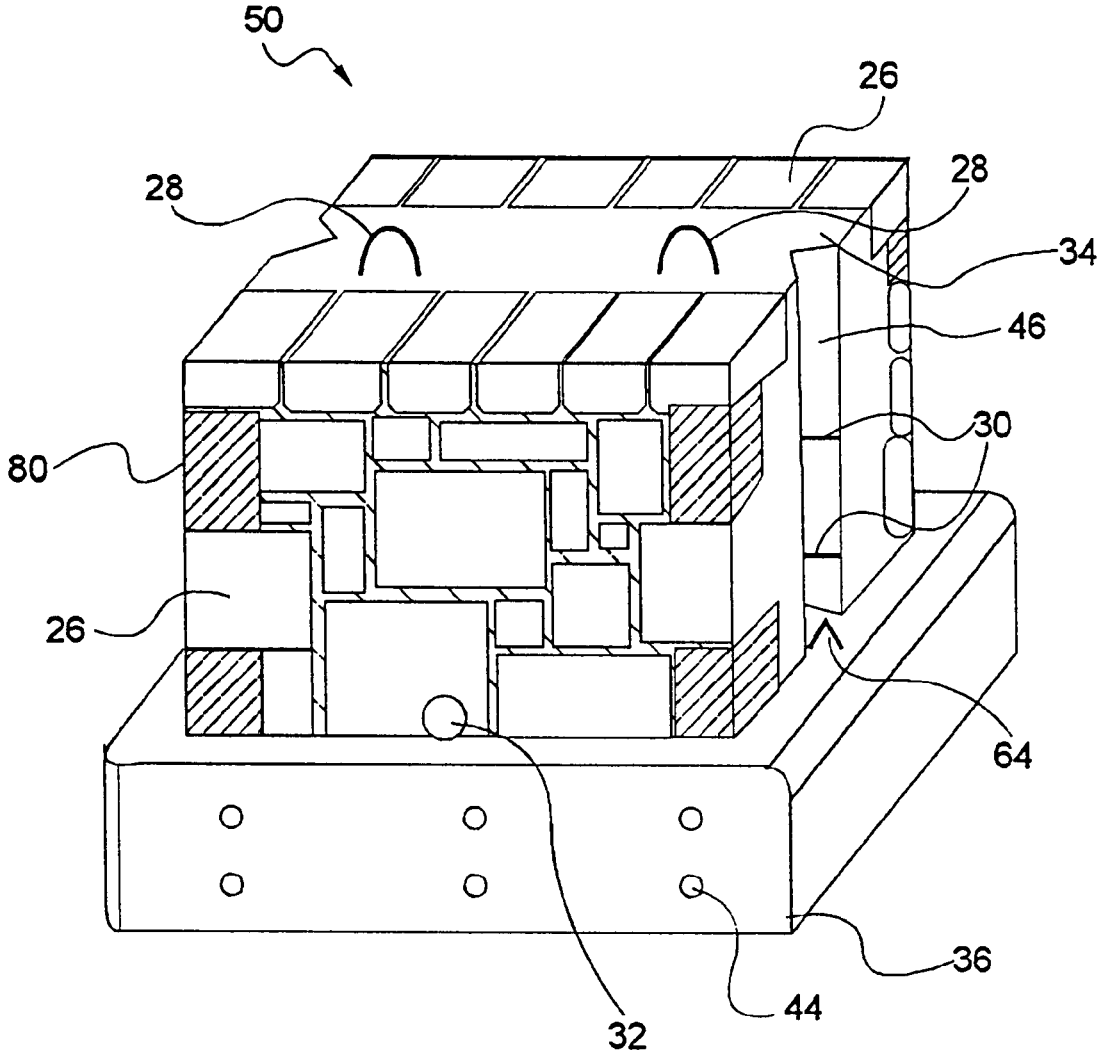
FIG. 4 depicts a perspective view of a double stone-face wall unit produced according to a preferred embodiment of the present invention.

A footing loop pocket 48 is shown formed along the bottom of the wall unit 50. Footing loop rods 70 may be formed that extend into the footing loop pocket 48, in mirror image fashion compared to the lifting loop rods 28 and the lifting loop pocket 58. The footing loop rods 70 may be used to anchor the wall unit to a concrete footing 36 or other base, typically by attachment to a footing-to-unit loop rod 64 (FIG. 4).

Also shown is a chaseway 32 which can accommodate pipes, culverts, wiring, drainage, unit lifting means, windows, doorways, or the like. The chaseway 32 may be placed at other locations within the wall unit 50. While only a single chaseway 32 is shown, a plurality of chaseways 32 may be employed as necessary.

Figure 3B:
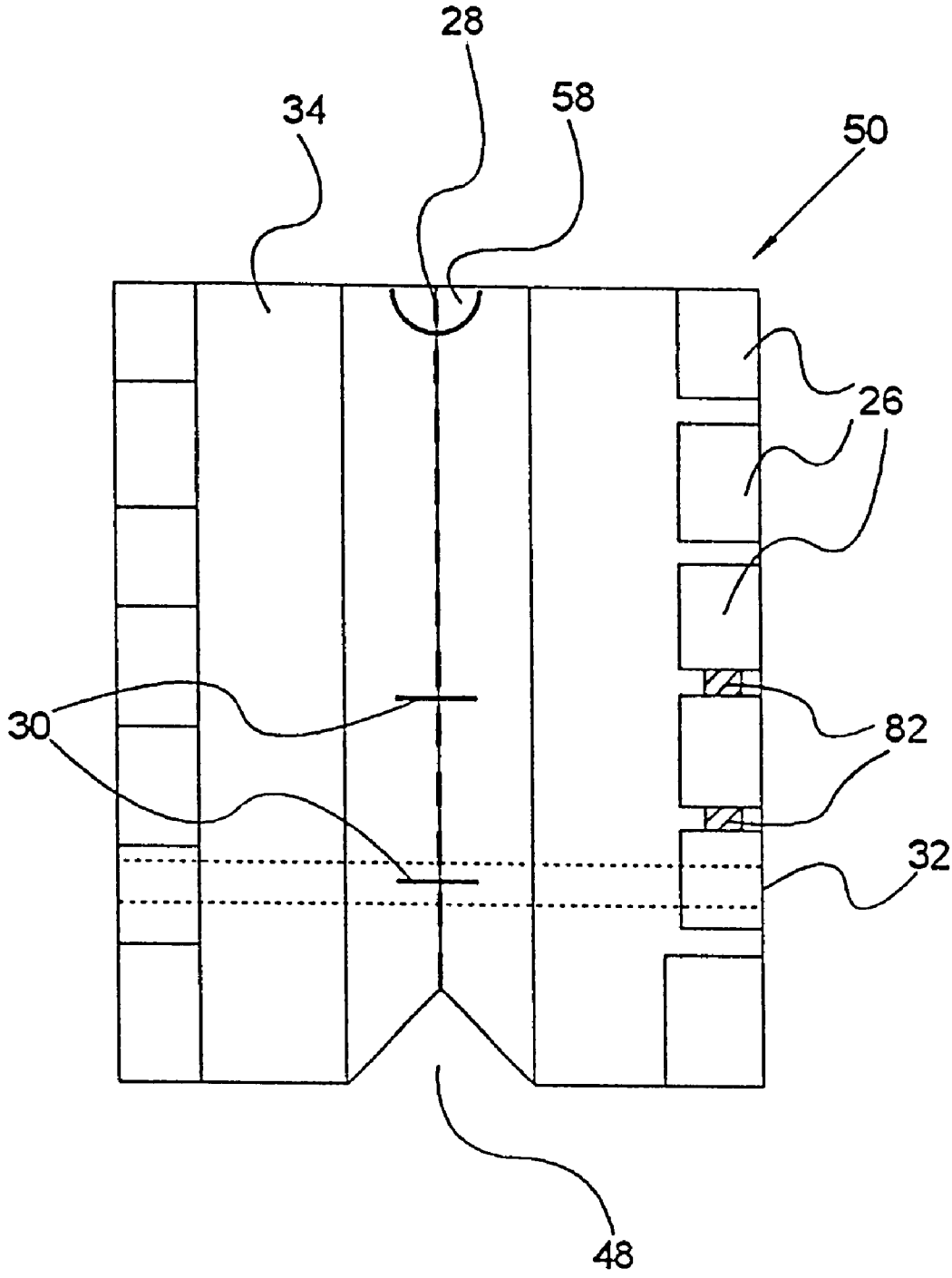

FIG. 3B shows a side view of a wall unit 50 presenting a second view of many of the features described above. Also shown here are a plurality of the stone veneer pieces 26. The veneer pieces 26 comprise the sides of the wall unit 50, while the inner space between the veneers is occupied by a binding or cementation material 34. The binding or cementation material 34 may be cement, concrete, mortar, or other suitably binding material such as certain foams and plastic compounds.

Figure 3C:
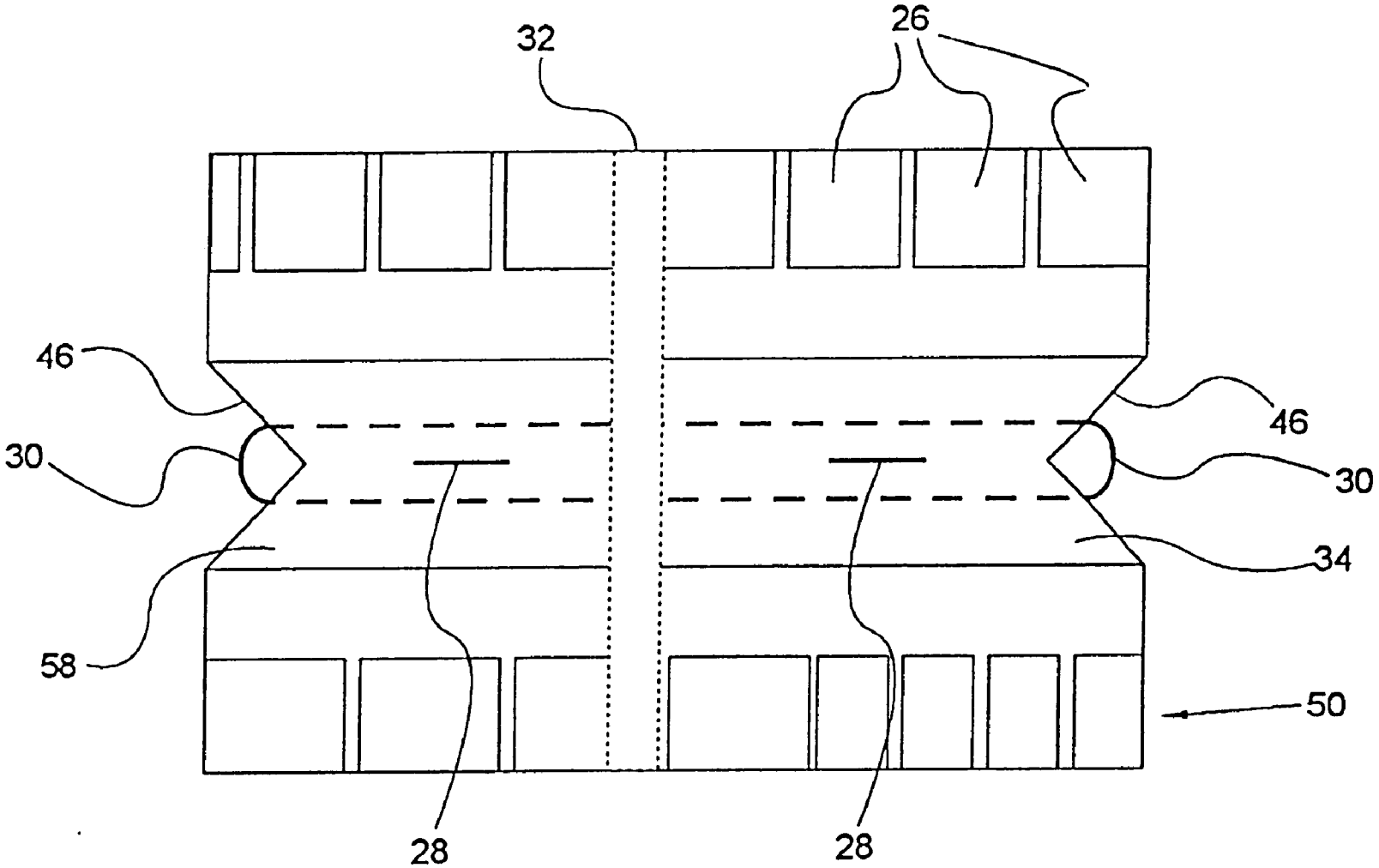

FIG. 3C depicts a plan view of the wall unit 50, which further presents the features discussed above.

Figure 6:
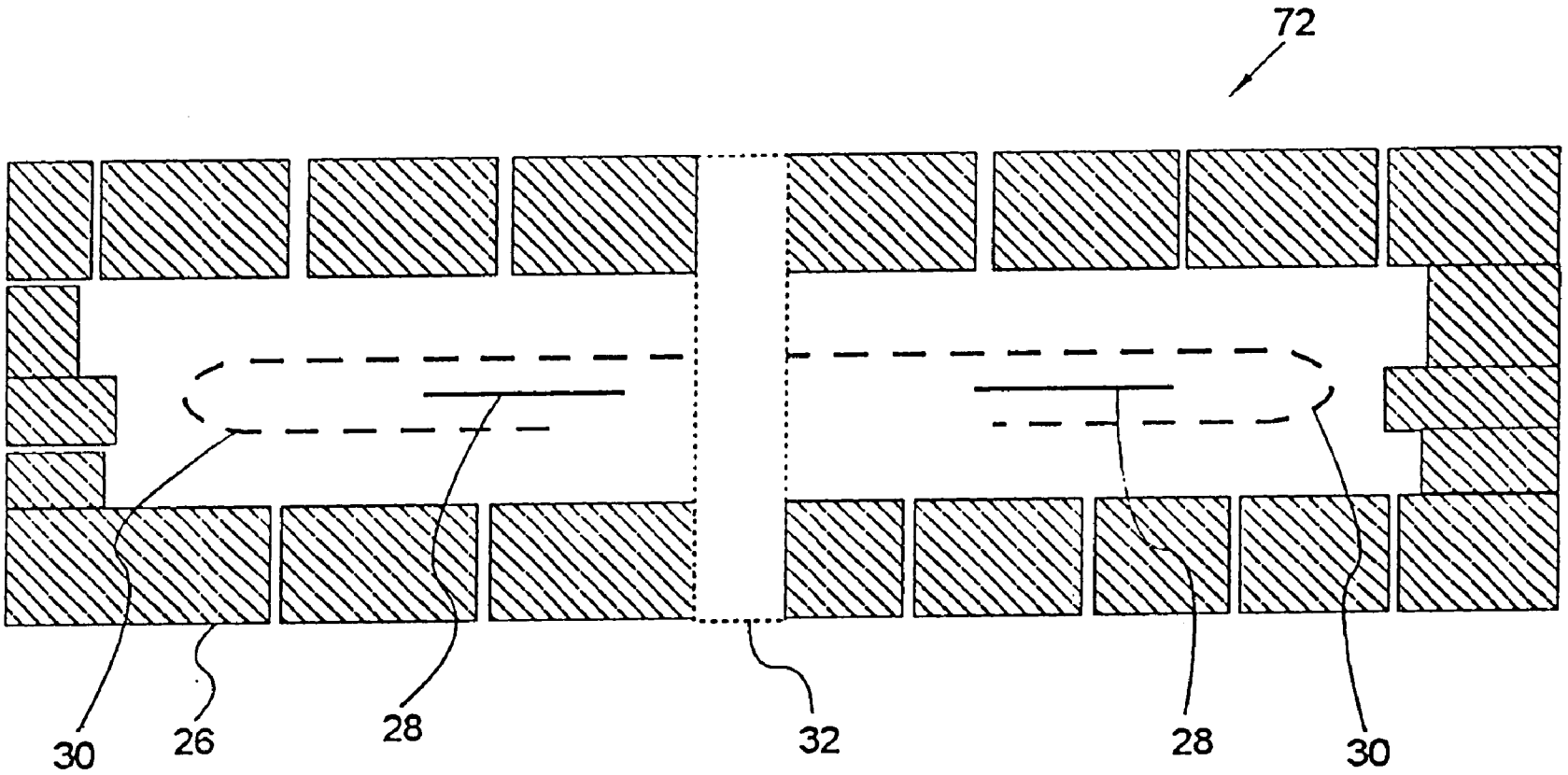
FIG. 6 depicts a plan view of a double corner end unit according to one possible embodiment of the present invention.
Figure 7:
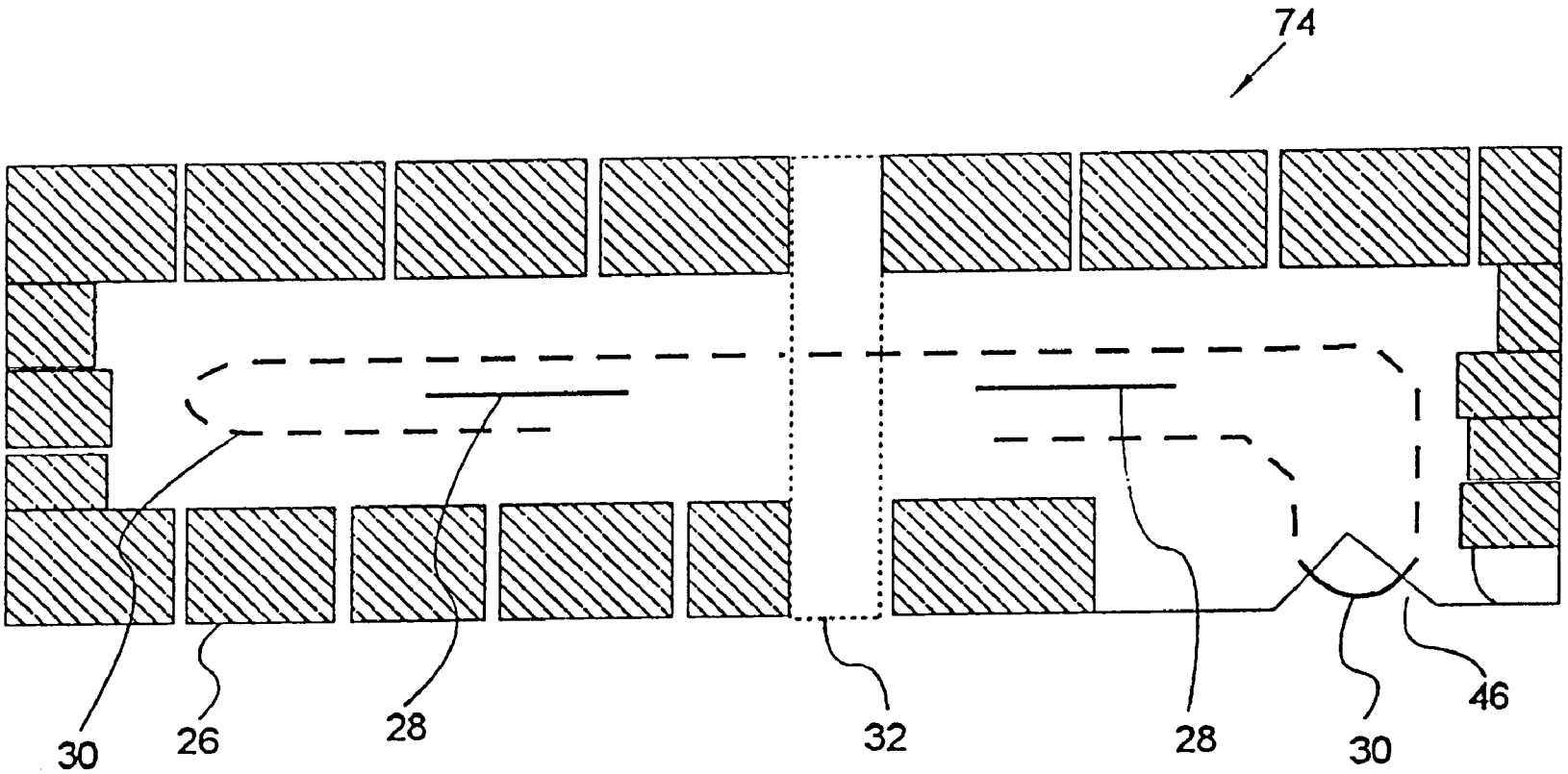
FIG. 7 depicts a plan view of a left or right corner end unit with an integral pocket formed therein according to one possible embodiment of the present invention.
Figure 8:
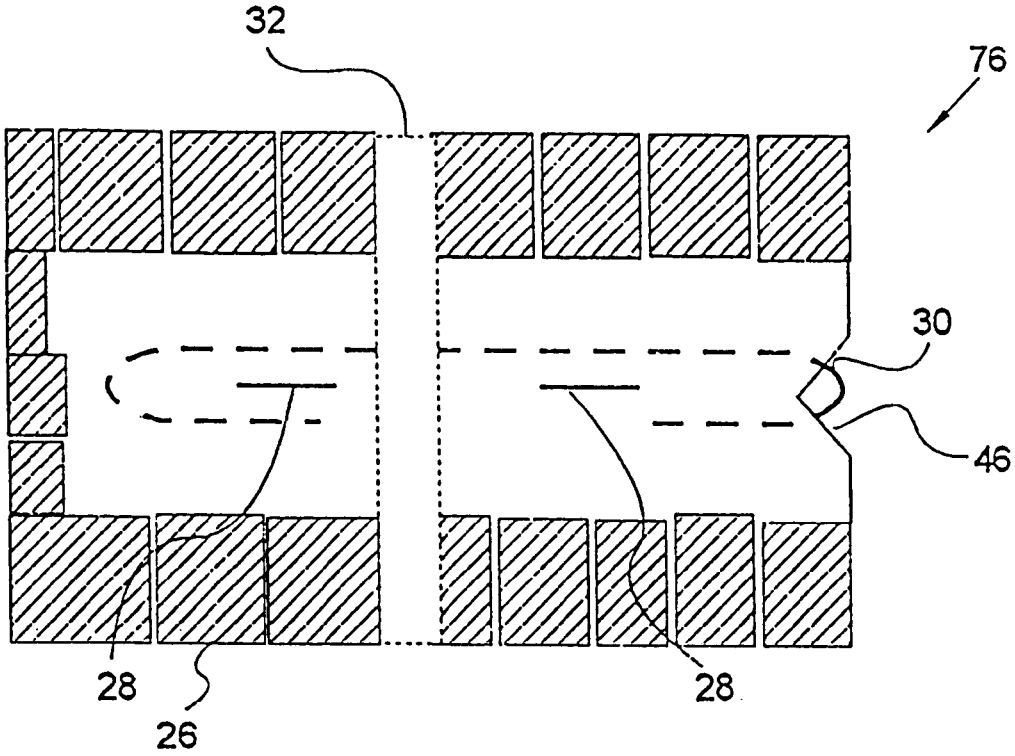
FIG. 8 depicts a plan view of a left or right end unit according to one possible embodiment of the present invention.
Figure 9:
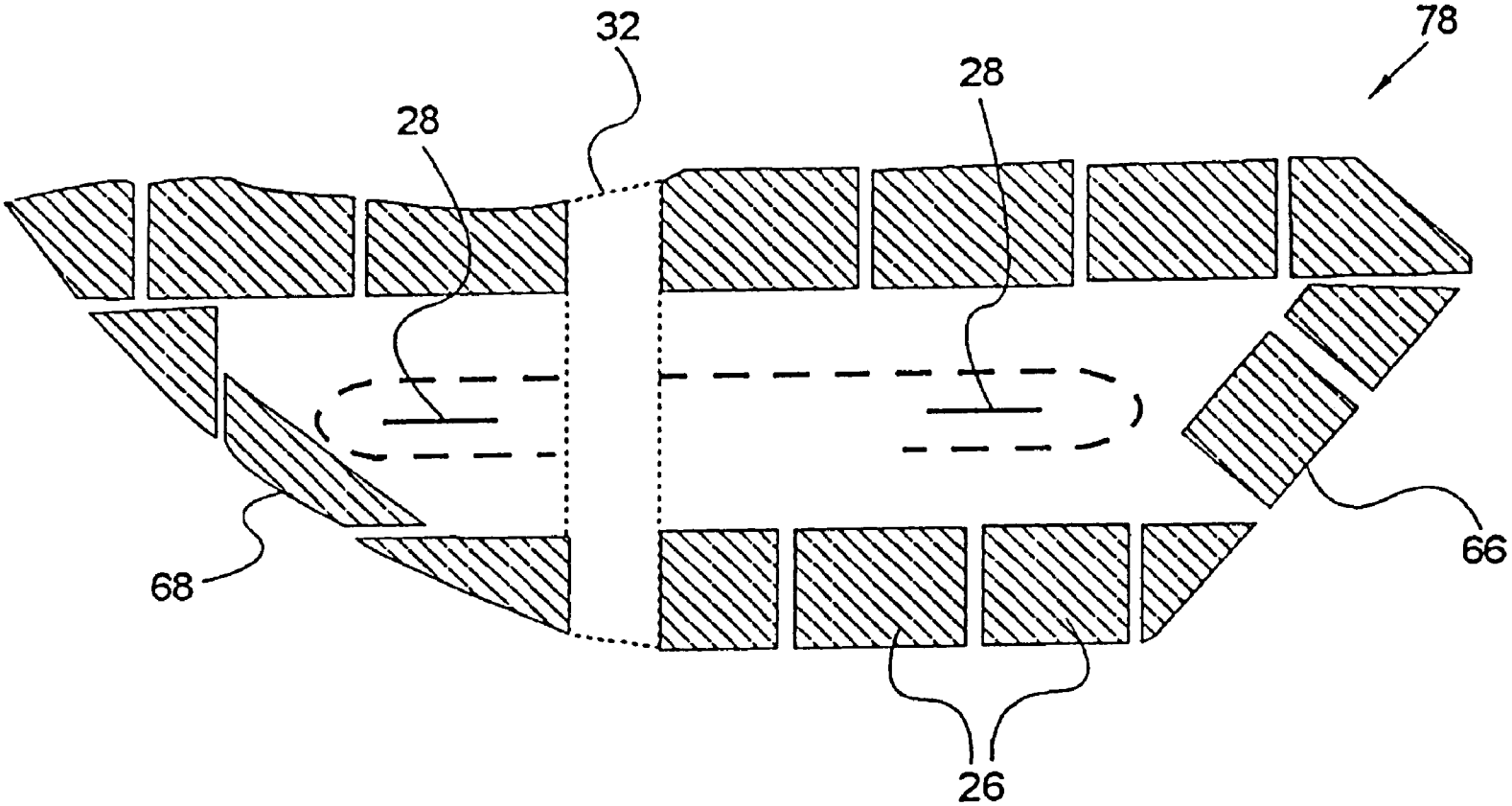
FIG. 9 depicts a plan view of a double corner end unit with nonlinear and tapered surfaces according to one possible embodiment of the present invention.

The wall units 50 are not limited to having a stone veneer 26 on one or two sides. They may have a stone veneer 26 on any number of sides. For instance, FIG. 6 shows a double corner end unit 72 which has a rectangular shape, and a stone veneer covering four sides. A left or right end unit 76 may also be formed (FIG. 8). Further, the connecting loop pocket 46 need not be placed at an end of the wall unit 50. It may be placed on a side to yield the left or right corner end unit 74 shown in FIG. 7. Finally, the wall unit form 10 is not limited to a rectangular shape. The sides may be angled or curved to meet any design criteria. FIG. 9 depicts a composite wall unit 78 which includes both of these features.

2. Method of Making the Wall Unit

The wall unit 50 is produced using the wall unit form 10 illustrated in FIGS. 1 and 2.

As a first step, hinged or removable first and second surfaces or side panels 12, 14 are removably attached to first and second end surfaces or panels 16, 18. The panels 12, 14, 16, and 18 may also be affixed to an optional surface base or panel 20 at this time. However, depending on the size and configuration of the wall unit 50 that is to be constructed, either end panel 16, 18 may be left off to facilitate access to the interior of the wall unit form 10. The wall unit form 10 may commonly have a rectangular shape, but could have any desired shape, including angled sides, curved sides, or sloped sides (FIG. 9).

Once the desired panels are in place, removable structures may be affixed to the panels. These structures function as connecting loop pocket structures 22, footing loop pocket structures 24, or lifting loop pocket structures 56, depending on their placement within the form.

Next, individual stones are placed along the bottom of at least one side panel. Successive layers of stones are stacked upon the initial layer, thereby forming a stone veneer 26. Smaller pieces of stone or non-stone material may be used as shims 82 (FIG. 3B) to ensure a specified gap or joint size between the stones. Alternatively, the stones may be stacked with no spaces between them. The stone veneer can also be built to accommodate chaseways, drainage pipes, culverts, windows, doorways, lighting fixtures, etc., as required. A stone veneer may be built against a single wall, or preferably, on more than one wall at the same time. For those units requiring that there be no visible seams between wall units 50, removable indentation blocks 80 (FIG. 4) are placed in appropriate locations in the stone veneer 26.

Once installation of the stone veneers 26 is completed, reinforcing rods are added as necessary to provide structural integrity, and to provide lifting loop rods 28, connecting loop rods 30, and footing loop rods 70.

Now that the discrete components of the wall unit 50 are in place, any panels 12, 14, 16, and 18 which were not installed earlier are attached to complete the form. The wall unit form 10 is then filled with a binding or cementation material 34. This binding material 34 is poured into the wall unit form 10 through the exposed upper area.

The binding material 34 may be textured or colored, and may be a mortar, cement, concrete or similar mixture, or a plastic or foam compound. The binding material 34 is then allowed to cure.

Figure 5:
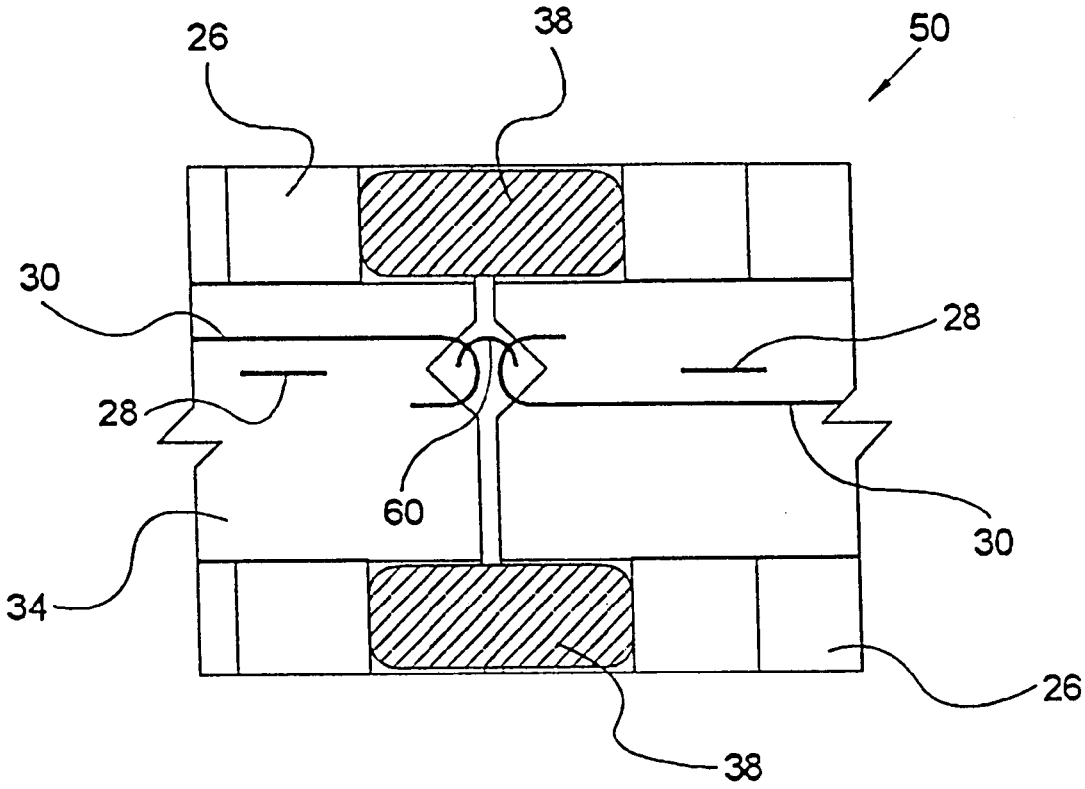
FIG. 5 depicts a detail plan view of the seamless joint between two wall units according to FIG. 4.

In some architectural applications it will be desirable for adjacent wall units 50 to appear as if there is no joint between them. In such cases, a temporary, removable indentation block 80 is placed at any suitable location in the stone veneer 26 array prior to addition of the binding material 34. The indentation block 80 is removed after curing, thus leaving a void in the stone veneer 26. A seamless joint can then be accomplished using a stone crossing joint 38 (FIG. 5) which is placed across the vertical joint between the units 50 utilizing the space vacated by the removable indentation block 80 (FIG. 4). Similarly, horizontal joints can be disguised between stacked wall units 50.

The wall unit 50 may also be formed with a footing or base 36, wherein the footing 36 which is poured as an integral portion of the wall unit 50 at the same time that the remainder of the wall unit 50 is poured.

The foregoing specification is intended as illustrative and is not intended to be taken as limiting. Still other variations within the spirit and scope of this invention are possible and will readily present themselves to those skilled in the art.

What is claimed is:

1. A method of constructing a wall unit using a molding technique, comprising:

operationally attaching a plurality of side panels and end panels in an upright manner to form a volume;

arranging at least two layers of discrete veneer components adjacent one of said plurality of panels, wherein said at least two layers include a first underlaying layer and a second overlaying layer, wherein said first layer and said second layer are vertically adjacent, and wherein portions of said second layer are in direct contact with portions of said first layer;

filling said volume with a binding material, wherein said filling is done in a single pour; and subsequent to curing of the binding material, removing said side panels and said end panels.

2. The method of constructing a wall unit of claim 1, further including the step of providing for at least one chaseway prior to the step of filling with the binding material.

3. The method of constructing a wall unit of claim 1, further including the step of removably attaching shaped structures to at least one of said side panels or said end panels in order to form an indentation in at least one surface.

4. The method of constructing a wall unit of claim 3, including the step of aligning said shaped structures to form interlocking members of adjacent wall units.

5. The method of constructing a wall unit of claim 1, including the step of forming an indentation to prepare a seamless joint.

6. The method of constructing a wall unit of claim 1, including the step of adding a coloring agent to the binding material.

7. The method of constructing a wall unit of claim 1, including the step of texturing the binding material.

8. The method of constructing a wall unit of claim 1, further including the step of applying an exterior coating to the wall unit.

9. The method of constructing a wall unit of claim 8, wherein the exterior coating is a weatherproofing material.

10. The method of constructing a wall unit of claim 8, wherein the exterior coating is a graffiti-resistant material.

11. The method of constructing a wall unit of claim 1, further including the step of forming a void to produce an integral base prior to the step of filling the volume.

12. The method of constructing a wall unit of claim 1, further including the step of adding reinforcing rods into the volume before the step of filling the volume.

13. A wall unit form and a wall unit comprising:

a first surface, formed by an interior surface of a first wall panel;

a second surface operatively attached to said first surface, said second surface formed by an interior surface of a second wall panel;

end surfaces operatively attached to said first and second surfaces thereby forming an upright form and opposing sides, said end surfaces formed by interior surfaces of a end wall panels;

wherein each of said first, second and end surfaces simultaneously supports of layers of discrete components during, a single pour application of a binding material to the wall unit form; and further wherein each of said first, second and end surfaces is shaped to be removably attached from one another to facilitate entry into a volume defined by the upright form.

14. The wall unit form and wall unit of claim 13, wherein at least one of the first surface, the second surface, and the end surfaces, is characterized by a nonrectangular aspect.

15. The wall unit form and wall unit of claim 13, wherein at least one of the first surface, the second surface, and the end surfaces, is characterized by curvilinear edges.

16. The wall unit form and wall unit of claim 13, further including said second and said end surfaces being hingedly attached to said first surface.

17. The wall unit form and wall unit of claim 13, further including a volume which will produce an integral footing when filled.

18. The wall unit form and wall unit of claim 17, further including an integral-footing-producing volume having radiused corners.

19. The wall unit form and wall unit of claim 13, further including a pocket structure operatively attached to at least one of said surfaces.

* * * * *